US007962066B2

(12) United States Patent
Arai et al.

(10) Patent No.: US 7,962,066 B2
(45) Date of Patent: Jun. 14, 2011

(54) CLEANING UNIT, IMAGE FORMING APPARATUS USING THE SAME, AND CLEANER

(75) Inventors: Kazuhiko Arai, Kanagawa (JP); Koichiro Yuasa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 107 days.

(21) Appl. No.: 12/261,614

(22) Filed: Oct. 30, 2008

(65) Prior Publication Data

US 2009/0257797 A1 Oct. 15, 2009

(30) Foreign Application Priority Data

Apr. 9, 2008 (JP) ..... P2008-101342

(51) Int. Cl.
*G03G 15/00* (2006.01)

(52) U.S. Cl. ..... 399/123; 399/343; 399/350; 399/351; 399/358; 399/360

(58) Field of Classification Search ..... 399/107, 399/110, 123, 343, 350, 351, 358, 360; 15/256.5, 15/256.51, 256.52
See application file for complete search history.

(56) References Cited

U.S. PATENT DOCUMENTS

| | | | | |
|---|---|---|---|---|
| 4,806,981 | A * | 2/1989 | Ishiguro et al. | 399/102 |
| 5,066,983 | A * | 11/1991 | Tonomoto | 399/349 |
| 2005/0214045 | A1 * | 9/2005 | Ohta et al. | 399/350 |

FOREIGN PATENT DOCUMENTS

| | | | |
|---|---|---|---|
| JP | 61094083 | A * | 5/1986 |
| JP | 09-016046 | | 1/1997 |
| JP | 3695496 | B | 7/2005 |
| JP | 2006-030730 | | 2/2006 |

* cited by examiner

*Primary Examiner* — David P Porta
*Assistant Examiner* — Casey Bryant
(74) *Attorney, Agent, or Firm* — Morgan, Lewis & Bockius LLP

(57) ABSTRACT

A cleaning unit includes a cleaner. The cleaner includes: a support member; a toner scraping member; and a toner storing mechanism. The toner storing mechanism includes: a toner catching member provided in a vicinity of a leading end of the toner scraping member so as to catch the toner scraped off; and a swingably supporting mechanism which supports swingably the toner catching member with a middle portion of the toner catching member as a swing fulcrum. A free end portion of the toner catching member protruding from the toner scraping member in the moving direction is a storage moving portion which moves based on an amount of the stored toner, and a portion opposite to the free end portion with respect to the swing fulcrum is a press portion which presses the toner scraping member toward the cleaned member based on a moving amount of the storage moving portion.

19 Claims, 12 Drawing Sheets

FIG. 12

| | EXAMPLE | NO TONER STORAGE | PROTRUSION TYPE (SMALL SIZE) | PROTRUSION TYPE (LARGE SIZE) |
|---|---|---|---|---|
| NO TONER INPUT (BACKGROUND IMAGE) | 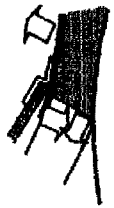 $\mu$=0.5<br>N=5.5 gf/mm<br>F=2.75gf/mm | 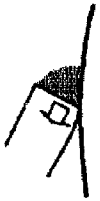 $\mu$=0.7<br>N=6 gf/mm<br>F=4.2gf/mm | 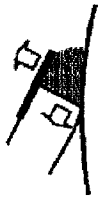 $\mu$=0.6<br>N=5.5 gf/mm<br>F=3.3gf/mm | 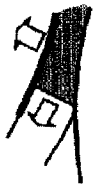 $\mu$=0.5<br>N=4.5 gf/mm<br>F=2.25gf/mm |
| TONER INPUT (100% SOLID IMAGE) | 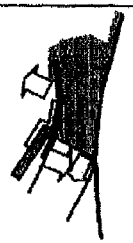 $\mu$=0.5<br>N=5.0 gf/mm<br>F=2.5gf/mm | 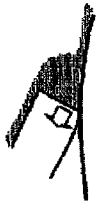 $\mu$=0.5<br>N=5.5 gf/mm<br>F=2.75gf/mm | 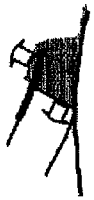 $\mu$=0.5<br>N=5.0 gf/mm<br>F=2.5gf/mm | 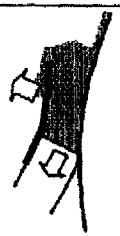 $\mu$=0.5<br>N=4.0 gf/mm<br>F=2.0gf/mm<br>(SLIP-THROUGH DEFECT) |
| DIFFERENCE | $\Delta$F=0.25gf/mm | $\Delta$F=1.45gf/mm | $\Delta$F=0.8gf/mm | $\Delta$F=0.25gf/mm |

CLEANING UNIT, IMAGE FORMING APPARATUS USING THE SAME, AND CLEANER

CROSS-REFERENCE TO RELATED APPLICATION

This application is based on and claims priority under 35 USC §119 from Japanese Patent Application No. 2008-101342 filed Apr. 9, 2008.

BACKGROUND (i) Technical Field

The present invention relates to a cleaning unit, an image forming apparatus using the same, and a cleaner.

(ii) Related Art

In an image forming apparatus adopting, for example, an electrophotographic system, there has been known a cleaning method in which toner on a photoconductor is scraped off by a blade that is a toner scraping member. It has been known that toner storage is utilized in this time in order to give lubricating property between the blade and the photoconductor.

SUMMARY

According to an aspect of the present invention, there is provided a cleaning unit comprising:

a cleaning housing having an opening portion opposed to a cleaned member; and a cleaner which is disposed in the cleaning housing correspondingly to the opening portion and which cleans toner on the cleaned member, wherein the cleaner includes:

a support member detachably supported by the cleaning housing;

a toner scraping member which is fixed to the support member and which comes at an leading end thereof into contact with the cleaned member against a moving direction of the cleaned member so as to scrape off the toner on the cleaned member; and a toner storing mechanism which stores temporarily the toner scraped off by the toner scraping member, the mechanism being provided upstream of the leading end of the toner scraping member in the moving direction of the cleaned member, wherein the toner storing mechanism includes:

a toner catching member which is provided in a vicinity of the leading end of the toner scraping member so as to catch the toner scraped off by the toner scraping member; and a swingably supporting mechanism which is fixed to the cleaning housing or the support member and which supports swingably the toner catching member with a middle portion of the toner catching member as a swing fulcrum, and wherein a free end portion of the toner catching member protruding from the toner scraping member in the moving direction of the cleaned member with respect to the swing fulcrum as a boundary is a storage moving portion which moves based on an amount of the stored toner, and a portion opposite to the free end portion of the toner catching member with respect to the boundary is a press portion which presses the toner scraping member toward the cleaned member based on a moving amount of the storage moving portion.

BRIEF DESCRIPTION OF THE DRAWINGS

Embodiments of the present invention will be described in detail based on the following figures, wherein:

FIG. 12 is an explanatory view showing a result in the example.

DETAILED DESCRIPTION

Outline of Embodiment

Firstly, an outline of an exemplary embodiment to which the invention is applied will be described.

Figure 1A:
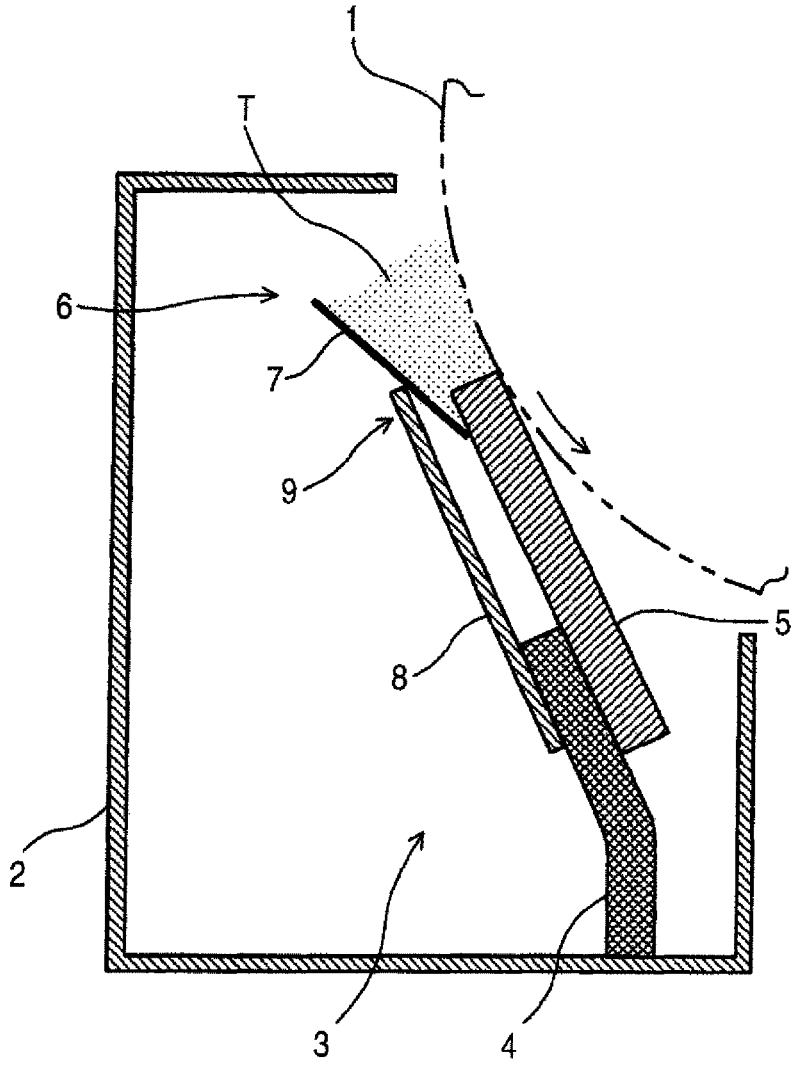
FIG. 1A is an explanatory view showing an outline of a cleaning unit according to an exemplary embodiment of the invention.
Figure 1B:
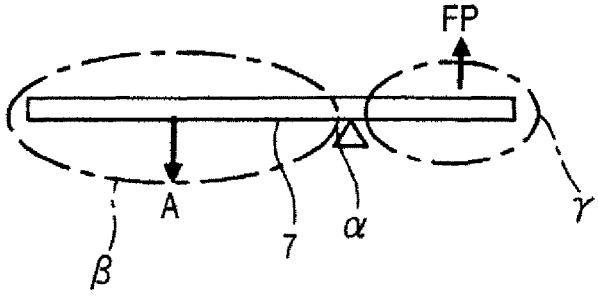
FIG. 1B is an explanatory view showing forces acting on a toner catching member.

FIGS. 1A and 1B are diagrams schematically showing an outline of a cleaning unit according to an exemplary embodiment of the invention. In the same figures, the cleaning unit in the embodiment includes a cleaning housing 2 having an opening portion opposed to a cleaned member 1, and a cleaner 3 which is provided in the cleaning housing 2 correspondingly to the opening portion and cleans toner T on the cleaned member 1. The cleaner 3 includes a support member 4 supported by the cleaning housing 2 detachably; a toner scraping member 5 which is fixed to this support member 4, and comes, at a leading end side thereof, into contact with the cleaned member 1 so as to be opposed to a moving direction of the cleaned member 1 thereby to scrape off the toner T on the cleaned member 1; and a toner storage mechanism 6 which stores temporarily the toner T scraped off by the toner scraping member 5 in an area on the more upstream side in the moving direction of the cleaned member 1 than a leading end portion of the toner scraping member 5. The toner storage mechanism 6 includes a toner catching member 7 provided in the vicinity of the leading end portion of the toner scraping member 5 protrusively from the toner scraping member 5 so as to catch the toner T scraped off by the toner scraping member 5; and a swingably supporting mechanism 9 which supports swingably the toner catching member 7, at a portion of an attachment member 8 fixed to the cleaning housing 2 or the support member 4, spaced from the leading end portion of the toner scraping member 5, with a middle portion of the toner catching member 7 as a swing fulcrum $\alpha$. Herein, with the swing fulcrum $\alpha$ as a boundary, a portion of the toner catching member 7 protruding from the toner scraping member 5 is taken as a storage moving portion β which moves based on the amount of the stored toner, while an opposite side portion of the toner catching member 7 is taken as a press portion γ which presses the toner scraping member 5 toward the cleaned member 1 side based on the moving amount of the storage moving portion β. FIG. 1B shows an outline of the toner storage mechanism 6. In case that the storage moving portion β deforms in a direction of an arrow A, the press portion γ exhibits press force FP in a direction of an arrow.

As long as the toner scraping member 5 can clean the toner T on the cleaned member 1 by bringing its leading end side into contact with the cleaned member 1 so as to face a rotational direction of the cleaned member 1, the material of the toner scraping member 5 is not particularly limited. However, from a viewpoint that the press force FP can be effectively applied, the toner scraping member 5 formed of rubber is suitable. Further, regarding arrangement of the toner scraping member 5, it is not an indispensable feature that the leading end thereof faces upward so as to store readily the toner T, but it is necessary that a toner storing area can be formed at the leading end portion. Further, from a viewpoint that the toner storing area effective for the toner scraping member 5 is provided, it is preferably that the toner scraping member 5 is disposed so as to come into contact with the cleaned member 1 so that its leading end portion faces upward.

Here, working of the toner storage mechanism 6 will be described.

In case that the toner on the cleaned member 1 is cleaned by the toner scraping member 5, in order to suppress deformation of the toner scraping member 5 and occurrence of wear of the cleaned member 1 thereby to ensure stable cleaning performance, it is suitable to keep lubricating property between the cleaned member 1 and the toner scraping member 5 by supplying the desired amount of toner T between them. Therefore, it is known that the toner storing area (toner storage) is provided at the leading end of the toner scraping member 5 and the toner T stored here is utilized as a lubricant.

Figure 2C:
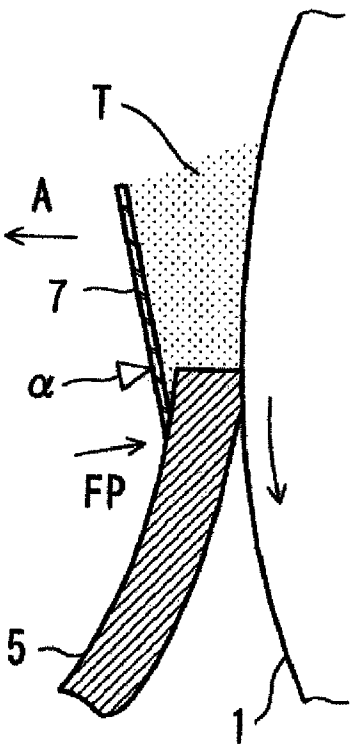
FIGS. 2A to 2C are explanatory views each showing a relation between a toner scraping member and toner.
Figure 2B:
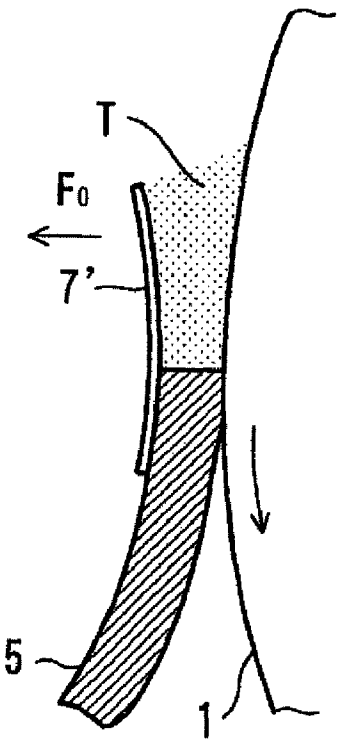
Figure 2A:
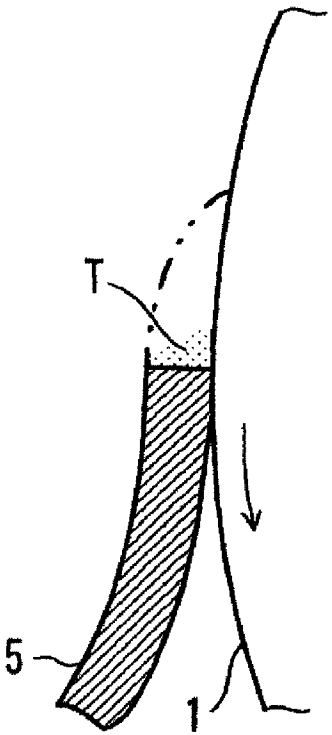

FIG. 2A is an outline view showing an example in which the positive toner storing area is not provided but the toner T remaining at the leading end of the toner scraping member 5 is simply utilized. In case that the toner storing amount at the leading end of the toner scraping member 5 is small, the amount of an external additive separating from the toner which slips between the toner scraping member 5 and the cleaned member 1 is small, so that the sufficient lubricating property cannot be obtained. Here, the external additive means minute particle of silica or titania having a diameter of 1 μm or less. On the other, when the toner storing amount increases (refer to a chain double-dashed line in FIG. 2A), the slip-through amount is ensured and the appropriate lubricating property can be maintained. Namely, in case that the positive toner storing area is not provided, the lubricating property is affected by the change in the storing amount of the toner T at the leading end of the toner scraping member 5, and it is difficult to secure the stable lubricating property.

To the contrary, it is supposed that: the storage area where the toner T is stored at the leading end of the toner scraping member 5 is positively provided in order to ensure some degree of the toner storing amount, and the stable cleaning performance is ensured regardless of the scraping amount by the toner scraping member 5. For example, as shown in FIG. 2B, it is thought that a catching member 7' which protrudes from the end portion of the toner scraping member 5 to catch the toner is provided, and this catching member 7' provides the storing area for the leading end of the toner scraping member 5. In this case, even if the amount of toner scraped off from the cleaned member 1 changes, the toner storing amount in the storing area can be ensured to some degree, so that the necessary lubricating property can be maintained. However, in case that the toner storing amount in the storing area is too large, a force $F_0$ in a direction where the catching member 7' is pulled apart from the cleaned member 1 acts, so that the force for pressing the toner scraping member 5 against the cleaned member 1 lowers. Therefore, much toner slips between the toner scraping member 5 and the cleaned member 1, so that the satisfactory cleaning on the cleaned member 1 is not performed.

Therefore, in the embodiment model, as shown in FIG. 2C, a toner catching member 7 is provided separately from the toner scraping member 5, and the principle of a lever is utilized in the toner catching member 7 which deforms based on the toner storing amount in the storing area. Namely, as the toner storing amount increases, movement in a direction of an arrow A where the toner catching member 7 is spread out is produced in the storage moving portion β, whereby the press force FP in a direction where the toner scraping member 5 is pressed against the cleaned member 1 acts on the press portion γ.

Therefore, even in case that the amount of the toner scraped off from the cleaned member 1 changes, the toner storing amount in the storing area can be stably ensured; and even in case that the toner amount increases too much, the amount of toner slipping between the toner scraping member 5 and the cleaned member 1 can be suppressed by the press force FP, whereby the stable lubricating property can be maintained.

In such the type of cleaning unit, from a viewpoint of the effective action of the press force FP against the toner scraping member 5, it is preferable that the swing fulcrum α for the toner catching member 7 is set in a position where the storage moving portion β becomes longer the press portion γ. Hereby, the press force FP which is larger than the force to be applied to the storage moving portion β with the swing fulcrum α as a center can be applied to the toner scraping member 5.

Further, it is preferable that the toner scraping member 5 is disposed so that its leading end portion comes into contact with the cleaned member 1 so as to face upward. In this case, the toner scraped off by the toner scraping member 5 is permitted to stay longer on the leading end surface of the toner scraping member 5, so that the effective storing area is readily formed. From a viewpoint of keeping the lubricating property in even a smaller amount of toner, it is preferable that the toner scraping member 5 is disposed so that the side which comes into contact with the cleaned member 1, of the leading end portion of the toner scraping member 5 faces downward.

The toner catching member 7 is preferably formed of warp-deformable material. The warp-deformation of the toner catching member 7 makes deformation at the storage moving portion β easy, so that the press force FP according to the deformation amount can act readily on the toner scraping member 5, and the operation of the toner catching member 7 itself can be stabilized. On the other, in case that the toner catching member 7 has rigidity, the press force FP can act on the press portion γ, but the moving amount at the storage moving portion β is suppressed to a small level.

As typical examples of the swingably supporting mechanism 9 in such the cleaning unit, there are an example in which the swingably supporting mechanism 9 couples the toner catching member 7 through a coupling tape to the attachment member 8, and this coupling portion functions as a swing fulcrum α; and an example in which a swing shaft is provided for one of the toner catching member 7 and the attachment member 8, a bearing portion is provided for the other thereof, and the swing shaft functions a the swing fulcrum α.

Further, in the example where the coupling portion functions as the swing fulcrum α, the press portion γ of the toner catching member 7 may be formed in the shape of an linearly extending shape, or may be curved nearly in the U-shape. Particularly, in case of the latter, from a viewpoint that detection sensitivity of the storing amount of the toner stored on the toner catching member 7 is improved, it is preferable that the storage moving portion β of the toner catching member 7 is disposed so that its leading end portion comes close to the cleaned member 1 from the outside of the toner scraping member 5.

Such the cleaning unit can be used also in an image forming apparatus. In this case, the cleaning unit is used as follows. Namely, the image forming apparatus includes an image forming section which forms a toner image on an image carrier, and a cleaning device which is disposed so as to be opposed to the image carrier and cleans toner on the image carrier; and uses the above-mentioned cleaning unit as the cleaning device. Here, the image carrier may be formed in the shape of a roll or in the shape of a belt.

Further, according to the embodiment model, the invention can be taken as a cleaner used in the cleaning unit. In this case, a cleaner 3, which is detachably provided for a cleaning housing 2 having an opening portion opposed to a cleaned member 1 and cleans toner T on the cleaned member 1, includes a support member 4 supported detachably by the cleaning housing 2; a toner scraping member 5 which is fixed to the support member 4 and comes, at its leading end side, into contact with the cleaned member 1 so as to face to the moving direction of the cleaned member 1 thereby to scrape the toner T on the cleaned member 1; and a toner storing mechanism 6 which temporarily stores the toner T scraped off by the toner scraping member 5 in a more upstream area in the moving direction of the cleaned member 1 than the leading end portion of the toner scraping member 5. The toner storing mechanism 6 includes a toner catching member 7 provided in the vicinity of the leading end portion of the toner scraping member 5 protrusively from the toner scraping member 5 so as to catch the toner T scraped off by the toner scraping member 5; and a swingably supporting mechanism 9 which supports swingably the toner catching member 7 at a portion of an attachment member 8 fixed to the support member 4, spaced from the leading end portion of the toner scraping member 5 with a middle portion of the toner catching member 7 as a swing fulcrum α. Herein, with the swing fulcrum α as a boundary, a portion of the toner catching member 7 protruding from the toner scraping member 5 is taken as a storage moving portion β which moves based on the amount of the stored toner, while an opposite side portion of the toner catching member 7 is taken as a press portion γ which presses the toner scraping member 5 against the cleaned member 1 side based on the moving amount of the storage moving portion β.

This invention will be described below more detailedly referring to exemplary embodiments shown in attached drawings.

Embodiment 1

Figure 3:
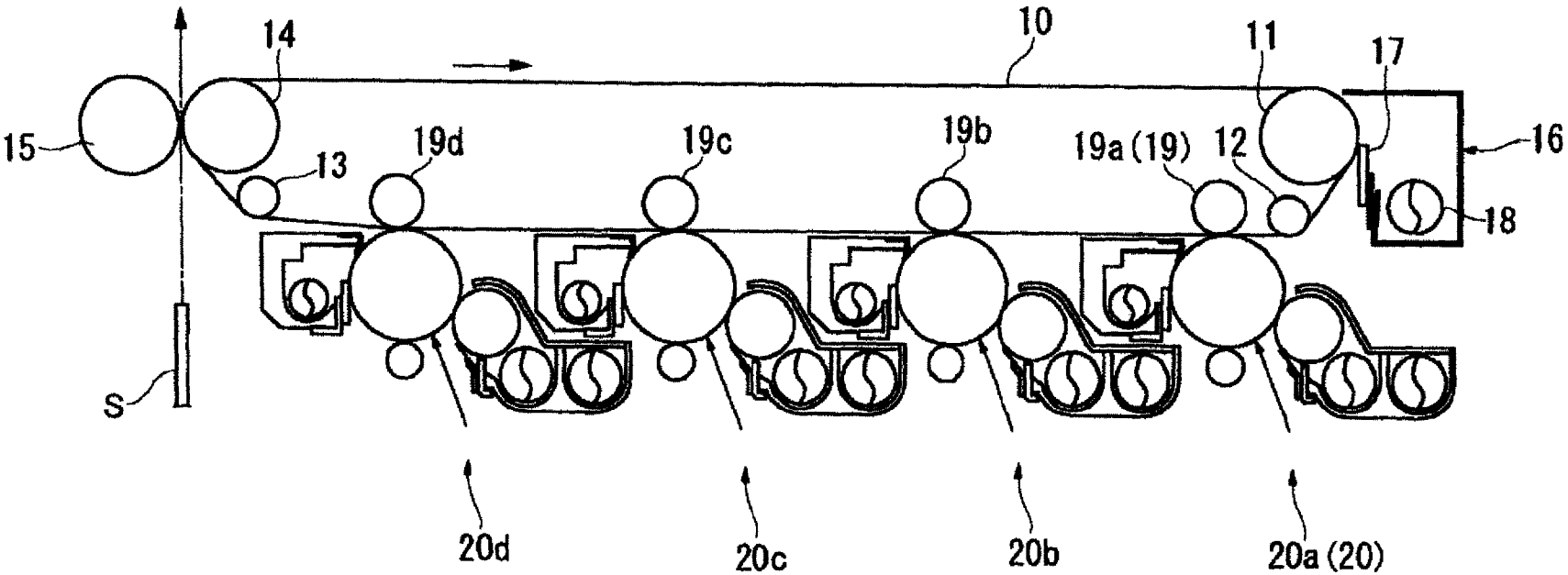
FIG. 3 is an explanatory view showing an image forming apparatus according to a first exemplary embodiment.

FIG. 3 shows an outline of an image forming apparatus in a first exemplary embodiment.

In FIG. 3, the image forming apparatus includes an intermediate transfer belt 10 which is stretched over plural tension rolls 11 to 14 in a substantially lateral direction and rotates circularly, and process cartridges 20 (20*a* to 20*d*) of four colors (for example, yellow, magenta, cyan, and black) which are arranged in a row along one side of the intermediate transfer belt 10.

The intermediate transfer belt 10 carries and conveys a toner image, and rotates circularly by means of, for example, the tension roll 11 as a drive roll. Around the intermediate transfer belt 10, a secondary transfer unit 15 such as a secondary transfer roll is provided in a position opposed to the tension roll 14 with the intermediate transfer belt 10 between. The tension roll 14 is used as a backup roll, and a secondary transfer field by which the toner image on the intermediate transfer belt 10 is transferred in a lump onto a recording material S supplied from a not-shown recording material supply section acts between the secondary transfer unit 15 and the tension roll 14. Further, in a position opposed to the tension roll 11 with the intermediate transfer belt 10 between, there is provided a belt cleaning unit 16 which cleans the residual toner on the intermediate transfer belt 10. The belt cleaning unit 16 includes a blade 17 which cleans the residual toner on the intermediate transfer belt 10, and an agitation carrying member 18 which carries the toner cleaned by the blade 17 to a not-shown waste toner housing part.

In this embodiment, in a position opposed to each process cartridge 20 on the rear surface of the intermediate transfer belt 10, there is provided a primary transfer unit 19 (19*a* to 19*d*) such as a primary transfer roll which transfers a toner image formed by the process cartridge 20 onto the intermediate transfer belt 10. Therefore, on the intermediate transfer belt 10, the toner images of the respective colors transferred by the respective primary transfer units 19 are multilayered. The multilayered toner images are transferred in a lump on the recording material S at the secondary transfer section. Between the primary transfer unit 19 and the process cartridge 20, a primary transfer field which transfers the toner image of each color onto the intermediate transfer belt 10 acts. Further, the recording material S onto which the toner images have been transferred in a lump at the secondary transfer section is fixed by a not-shown fixing unit.

Figure 4:
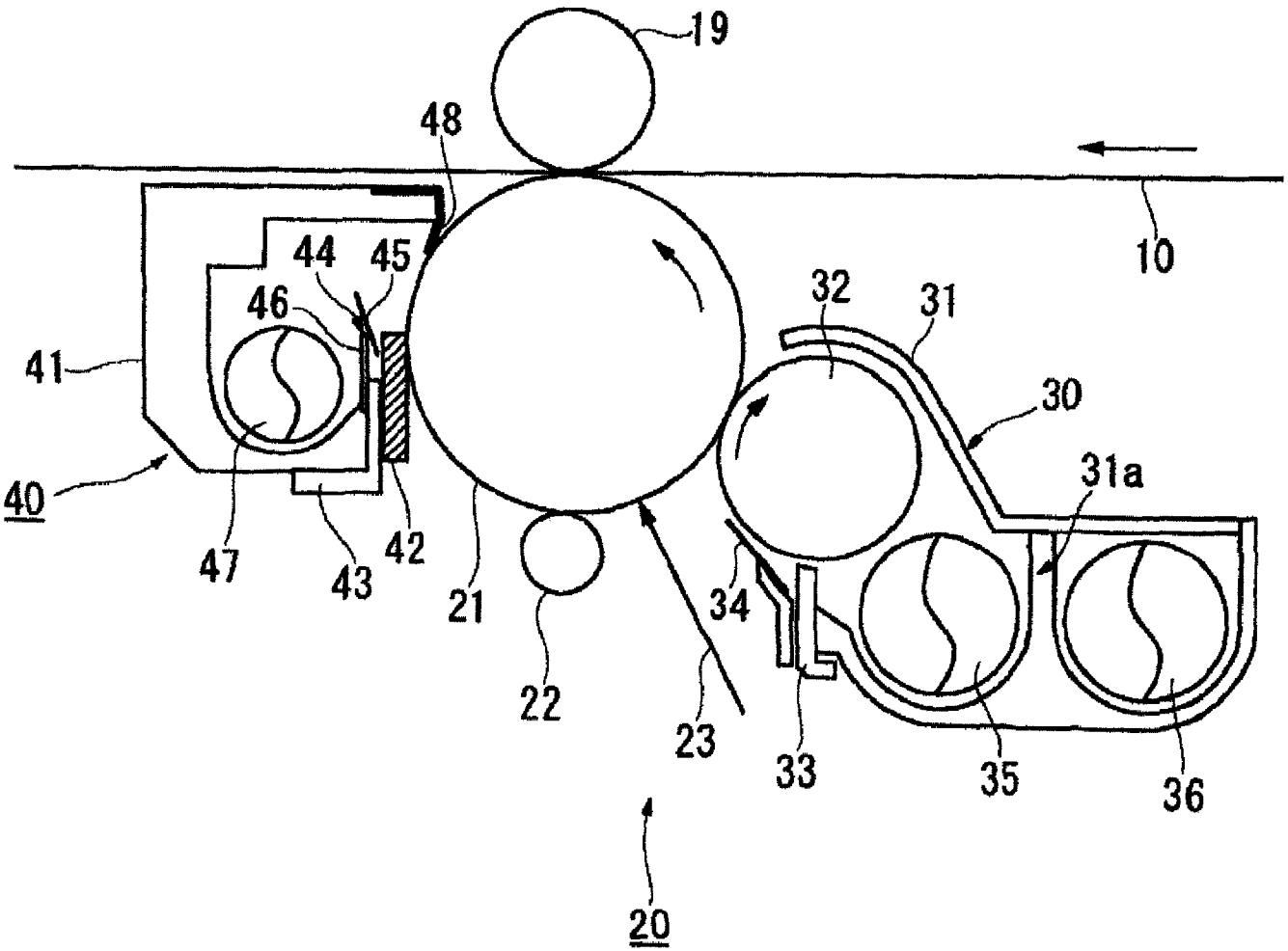
FIG. 4 is an explanatory view showing a process cartridge according to the first embodiment.

FIG. 4 shows a single process cartridge 20. The process cartridge 20 in this embodiment is constituted detachably from a housing of the image forming apparatus. Since the plural process cartridges 20 have the substantially same configuration except the used toner, one process cartridge 20 will be described here.

The process cartridge 20 in this embodiment includes a photoconductor 21 as an image carrier which carries a toner image; a charge roll 22 which charges the photoconductor 21; a developing unit 30 which develops with toner a latent image formed by exposing the photoconductor 21 charged by the charge roll 22 to the light, and makes the latent image into an visible image; and a cleaning unit 40 which cleans the residual toner on the photoconductor 21 after the toner image on the photoconductor 21 has been transferred onto the intermediate transfer belt 10 at the primary transfer section. An arrow shown by numeral 23 shows a laser beam irradiated from a laser scanning unit as a not-shown exposing unit correspondingly to each color. One laser scanning device can expose the photoconductor 21 of the process cartridge 20 for each color to the light through a clearance (not shown) of a frame of the process cartridge 20.

Further, the developing unit 30 in the embodiment uses two-component developer including toner and carrier, and includes a housing 31 having an opening portion in a position corresponding to the photoconductor 21, in which a development roll 32 is arranged in a position facing to this opening portion and opposed to the photoconductor 21. The development roll 32 includes a magnet body in which N-poles and S-poles are appropriately arranged, and a non-magnetic development sleeve turns around the magnet body. Around the development roll 32, a regulation member 33 which regulates the layer thickness of the developer on the development roll 32 is arranged with a predetermined clearance in relation to the development roll 32. On the more downstream side in the rotational direction of the development roll 32 than this regulation member 33, a seal member 34 secured to the housing 31 is provided, which prevents the developer regulated by the regulation member 33 from dispersing to the outside. On the other hand, on the more upstream side in the rotational direction of the development roll 32 than the regulation member 33, a supply-agitation carrying member 35 which supplies mainly the developer to the development roll 32 is arranged diagonally to the downside of the development roll 32 so as to be opposed to the development roll 32, and a mixture-agitation carrying member 36 which performs mainly triboelectric charging of the developer is provided at the back of this supply-agitation carrying member 35. Between the supply-agitation carrying member 35 and the mixture-agitation carrying member 36, the developer can be circulated through an opening portion of a partition wall 31*a* of the housing 31.

In the thus constructed developing unit 30, the developer agitated and carried by the two agitation carrying members 35 and 36 is supplied onto the development roll 32 by the supply-agitation carrying member 35. The developer supplied onto the development roll 32, of which the layer thickness is regulated by the regulation member 33, is carried, in a state where a predetermined amount of a developer layer has been formed, to a development area that is an opposing portion to the photoconductor 21. In the development area, by action of a development field between the photoconductor 21 and the development roll 32, the toner in the developer flies correspondingly to the latent image on the photoconductor 21, and the latent image on the photoconductor 21 is made into a visible image. Further, the developer which has gone over the development area is collected to the supply-agitation carrying member 35 by action of a repulsion magnetic field by magnetic pole arrangement. Although the developing unit 30 uses the two-component developer in the embodiment, the developer is not limited to the two-component developer, but, for example, a development system using only toner may be utilized.

The cleaning unit 40 includes a housing 41 that is a cleaning housing, and a cleaner which is correspondingly provided for an opening portion of the housing 41 and cleans the toner on the photoconductor 21. Further, the cleaner includes a nearly L-shaped blade support member 43 which is detachably supported by the housing 41; a blade 42 as a toner scraping member which is fixed at its base end side to this blade support member 43, and brings its leading end side into contact with the photoconductor 21 so as to be opposed to the rotational direction of the photoconductor 21 thereby to scrape the toner on the photoconductor 21; and a toner storing mechanism 44 which stores temporarily the toner scraped off by the blade 42 in a more upstream area in the moving direction of the photoconductor 21 than the leading end portion of the blade 42.

Further, the toner storing mechanism 44 includes a toner catching member 45 which is provided in the vicinity of the leading end portion of the blade 42 protrusively from the blade 42 so as to catch the toner scraped off by the blade 42; and a swingably supporting mechanism which supports swingably the toner catching member 45 at a portion of an attachment member 46 fixed to the blade support member 43, spaced from the leading end of the blade 42 with a middle portion of the toner catching member 45 as a swing fulcrum.

Further, in the cleaning unit 40, there are provided an agitation carrying member 47 which carries the toner in the housing 41 to a not-shown waste toner accommodating part, and a seal lip 48 for preventing the toner scraped off by the blade 42 from dispersing out of the housing 41.

Here, as the blade 42 for scraping the toner on the photoconductor 21, a blade made of synthetic rubber is usually used. Further, as the toner catching member 45, a flexible sheet member which is flexible and deformable is used; and as the flexible sheet member, a sheet member made of plastic such as PET, or a thin plate made of metal may be used. In the embodiment, in consideration of workability, a PET sheet having a thickness of 0.3 mm is used.

Figure 5:
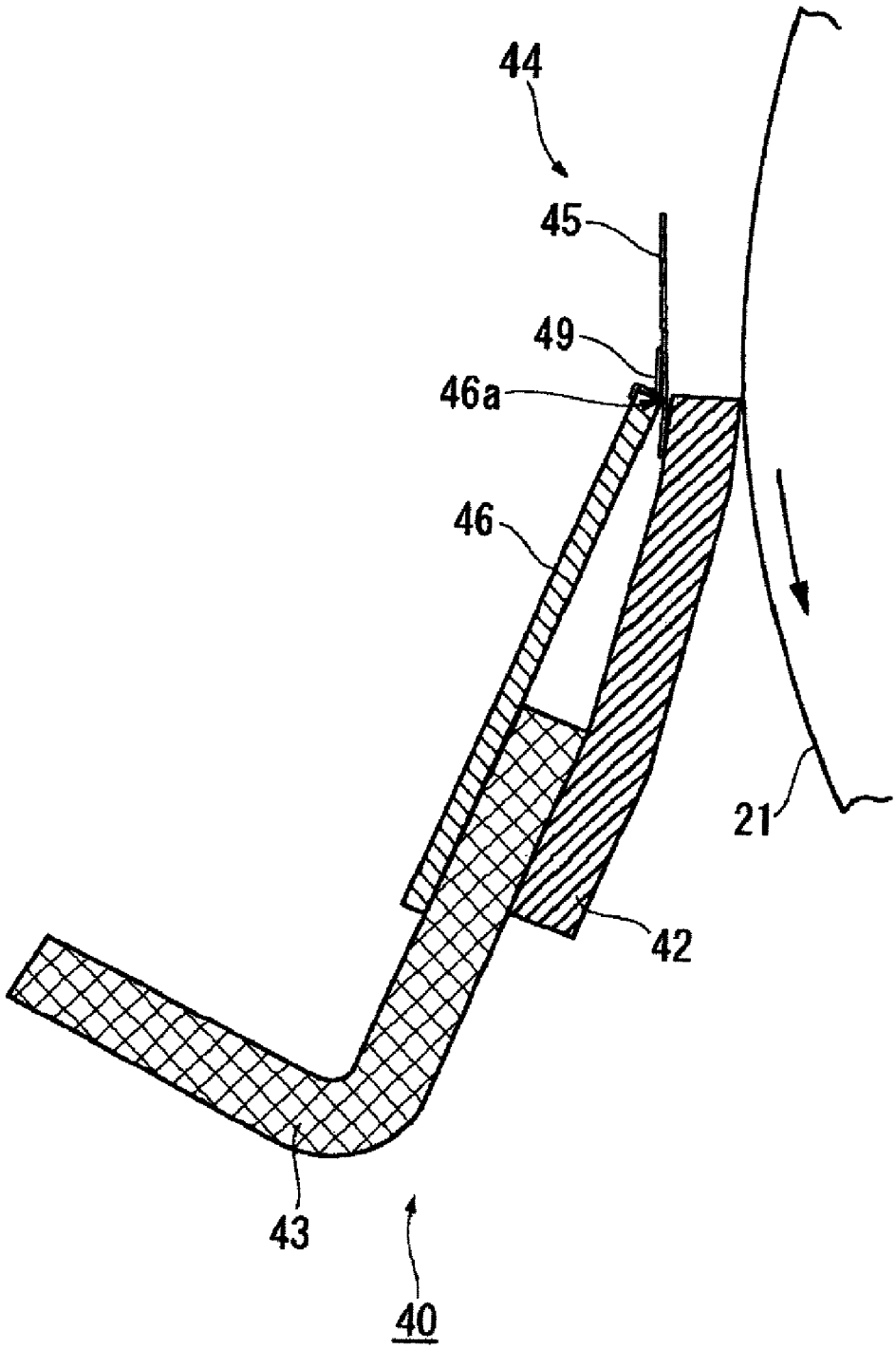
FIG. 5 is an explanatory view showing an outline of a cleaning unit in the first embodiment.

FIG. 5 shows a part of the cleaning unit 40 which is enlarged. Herein, the leading end side of the blade 42 comes into contact with the photoconductor 21 so as to be opposed to the rotational direction of the photoconductor 21, and the blade 42 is disposed so that its leading end side faces upward and so that a predetermined press force is applied to the photoconductor 21 by the blade support member 43. Particularly, in the embodiment, the side of the leading end of the blade 42 which comes into contact with the photoconductor 21 is disposed so as to extend more downward than the other side thereof.

Further, the leading end of the attachment member 46 comes into contact with the toner catching member 45. Furthermore, the leading end of this attachment member 46 and the toner catching member 45 are coupled through a coupling tape 49 such as an adhesive tape, and an edge portion 46*a* of the attachment member 46 is located in a predetermined position of the toner catching member 45 to become the swing fulcrum. Therefore, in this embodiment, the attachment member 46 and the coupling tape 49 function as the swingably supporting mechanism.

In the embodiment, with the swing fulcrum as a boundary, a portion of the toner catching member 45 protruding from the blade 42 is taken as a storage moving portion which moves based on the amount of the stored toner, while an opposite side portion of the toner catching member 45 is taken as a press portion which presses the blade 42 toward the photoconductor 21 side based on the moving amount of the storage moving portion. Further, in the embodiment, the swing fulcrum is provided in the portion which is close to the blade 42, of the toner catching member 45. Although a part of the attachment member 46 is utilized as the swing fulcrum, the invention is not limited to this, but the swing fulcrum may be constituted by the body different from the attachment member 46.

In the embodiment, by the thus constructed cleaning unit 40, the toner on the photoconductor 21 scraped off by the blade 42 drops from the blade 42 and is not collected as it is, but Is stored between the toner catching member 45 and the photoconductor 21. Namely, a storage area where the toner is stored is formed at the leading end of the blade 42, and the scraped toner is stored here.

Figure 6:
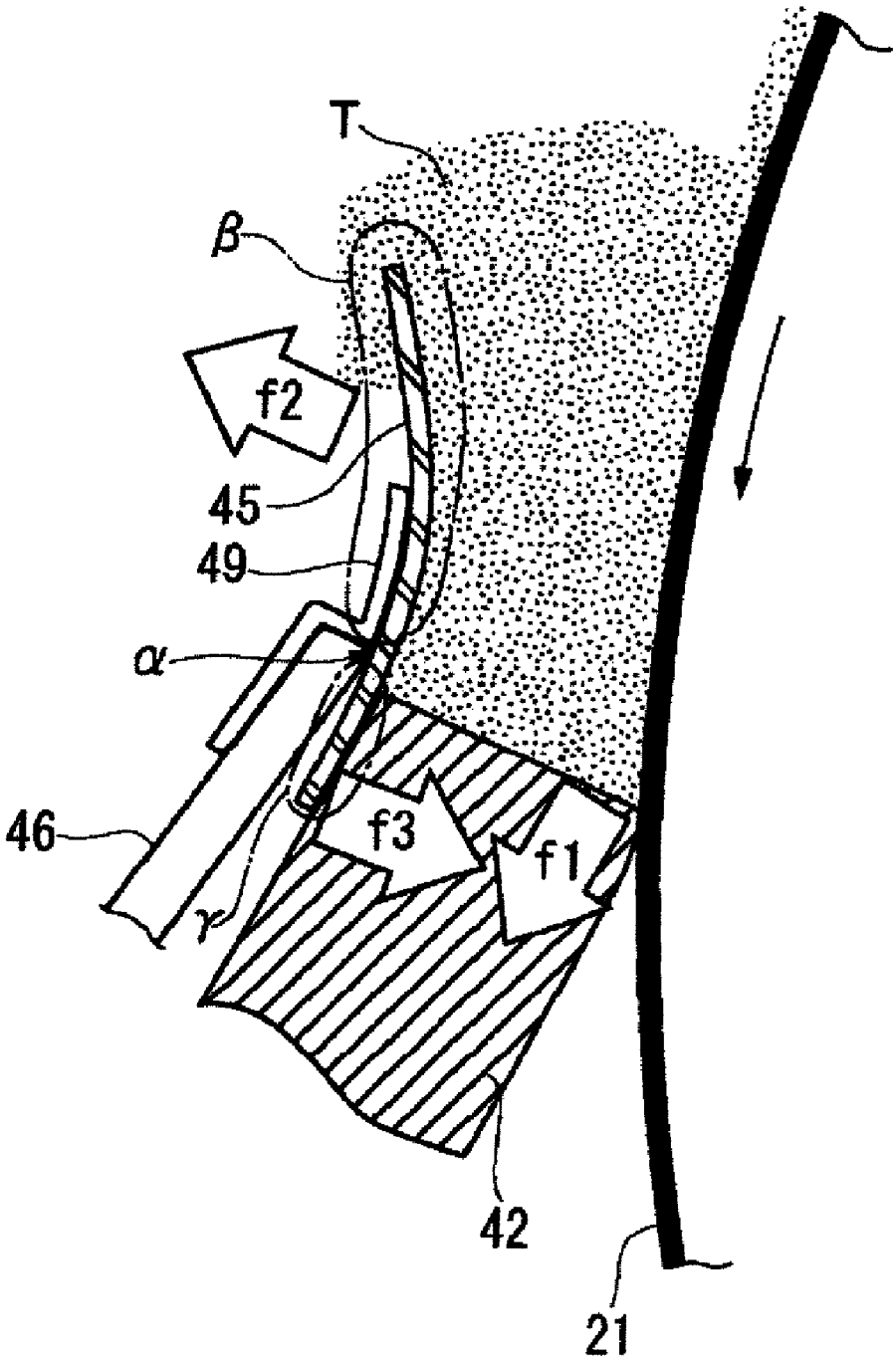
FIG. 6 is an explanatory view showing action of the cleaning unit in the first embodiment.

Next, working by the toner catching member 45 in the embodiment will be described below in detail with reference to FIG. 6.

As the toner T is stored in the toner storing area on the leading end side of the blade 42, a force f1 which is going to press down the blade 42 comes to be produced by the toner T and rotation of the photoconductor 21, and reaction force to this force f1 comes to be produced, thereby to balance with the force f1. On the other hand, by a force (not shown) which presses the blade 42 toward the photoconductor 21, a reaction force to its force comes to act on the blade 42. At this time, when the amount of the toner T in the storing area increases, and a force f2 which is going to spread the toner catching member 45 outward acts on the storage deforming portion β of the toner catching member 45, a press force f3 (force corresponding to FP in FIG. 1) in the opposite direction to the direction of f2 comes to act on the press portion γ of the toner catching member 45.

Namely, to the blade 42, the force which is going to separate the blade 42 from the photoconductor 21 due to the storage of the toner T, and the force which is going to press the blade 42 toward the photoconductor 21 side are applied. Since these forces act in counterbalanced directions, the change in the force of pressing the blade 42 against the photoconductor 21 becomes smaller, and regardless of the amount of the toner stored in the storing area, the blade 42 keeps pressing the photoconductor 21 by more stable pressure.

Namely, in case that the amount of the toner T stored in the storing area is small, the toner catching member 45 does not function, and the stored toner T slips between the blade 42 and the photoconductor 21 as it is, whereby lubricating property is maintained. On the other hand, in case that the amount of the toner T stored in the storing area increases, the force which is going to separate the blade 42 from the photoconductor 21 is suppressed by the toner catching member 45, whereby the stable slip-through amount can be secured, and regardless of the amount of the toner scraped off by the blade 42, the satisfactory lubricating property can be maintained over a long period of time.

In the embodiment, a case where an angle made by the leading end of the blade 42 and a tangent of the photoconductor 21 is an acute angle is shown. In this case, compared with a case where its angle is an obtuse angle, the amount of the toner slipping between the blade 42 and the photoconductor 21 can be held over a long period of time, so that maintenance of the lubricating property is satisfactory. However, even in case that its angle is a right angle or an obtuse angle, considering that the toner T scraped off from the photoconductor 21 remains readily on a portion close to the photo conductor 21, of the blade 42, it is possible to maintain the lubricating property for a long period. Further, after some degree of toner has been stored in the storing area, such the angle does not have a great influence.

Further, in the embodiment, although the attachment member 46 constituting the swing fulcrum α is fixed to the blade support member 43, the attachment member 46 may be provided through a bracket projecting from the housing 41, or may be provided directly for the housing 41.

Further, although the cleaning unit 40 is used for the photoconductor 21, it is clear that the cleaning unit 40 can be used for cleaning the toner T on the image carrier which carries the toner image, and the image carrier may be an intermediate transfer body which carries temporarily the toner image and conveys it.

Embodiment 2

Figure 7A:
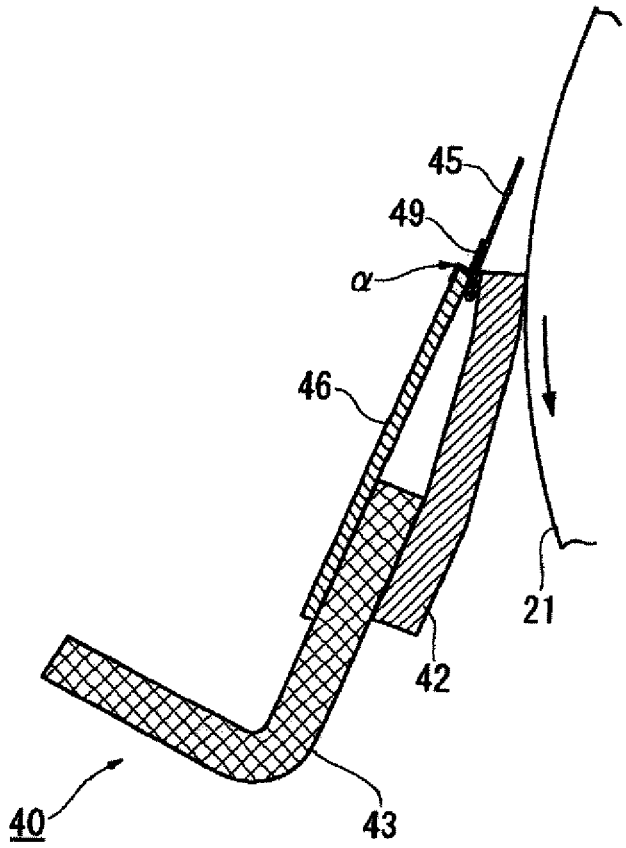
FIG. 7A is an explanatory view showing an outline of a cleaning unit according to a second exemplary embodiment.
Figure 7B:
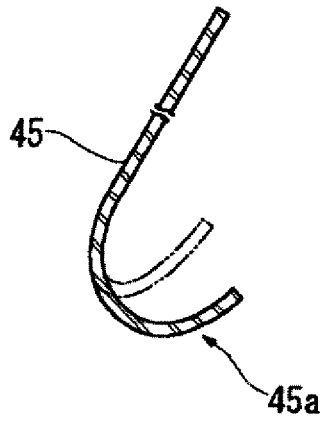
FIG. 7B is an explanatory view showing the shape of a toner catching member.

FIG. 7A shows an outline of a cleaning unit 40 in a second exemplary embodiment. The cleaning unit 40 in this embodiment has the substantially similar constitution to the constitution of the cleaning unit 40 in the first embodiment, but it is different from the unit in the first embodiment in the shape of a toner catching member 45. FIG. 7B shows an appearance when the toner catching member 45 is in a free state. Further, components similar to those in the first embodiment are denoted by the same characters, and the detained description of them is omitted here.

In the toner catching member 45 in this embodiment, an end side (corresponding to the press portion γ side) coming into contact with a blade 42 is formed into a curved portion 45*a* that is substantially U-shaped. The formation of such the curved portion 45*a* is readily achieved by a method of heating, for example, a PET sheet while the PET sheet is kept curved by a mold.

In case that the cleaning unit 40 to which the toner catching member 45 having such the curved portion 45*a* has been attached is installed in relation to a photoconductor 21, the blade 42 deforms toward an attachment member 46 and squashes the curved portion 45*a* of the toner catching member 45 as shown by a chain double-dashed line. At this time, although the curved portion 45*a* comes to be squashed as it is, since the curved portion 45*a* keeps, at any portion thereof, the contact state with the blade 42, the curved portion 45*a* presses the blade 42 at its contact portion.

In particular, in the embodiment, the toner catching member 45 is arranged in a direction where its leading end side (leading end side of the storage moving portion β) narrows in relation to the photoconductor 21.

Under such the constitution, as the toner is stored in the storing area, the toner catching member 45 comes to open outward. This fact means that the press force of pressing the blade 42 is produced in the curved portion 45*a* with the swing fulcrum α as a center. In particular, by providing such the curved portion 45*a* for the toner catching member 45, force in a direction where the curved portion 45*a* itself is restored to the original state can be applied to the blade 42, so that the press force can be effectively applied to the blade 42. Further, in the embodiment, since the toner catching member 45 is arranged so that its leading end narrows, even in case that the amount of the toner stored in the storing area is small, the deformation of the toner catching member 45 is readily performed. Compared with the case in the first embodiment, the detection sensitivity for the toner storing amount becomes satisfactory.

Figure 8B:
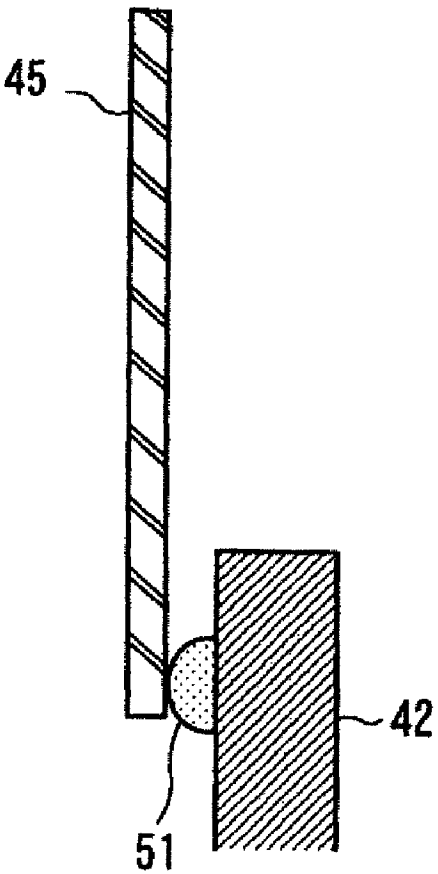
FIGS. 8A and 8B are explanatory views showing modified examples of the second embodiment.
Figure 8A:
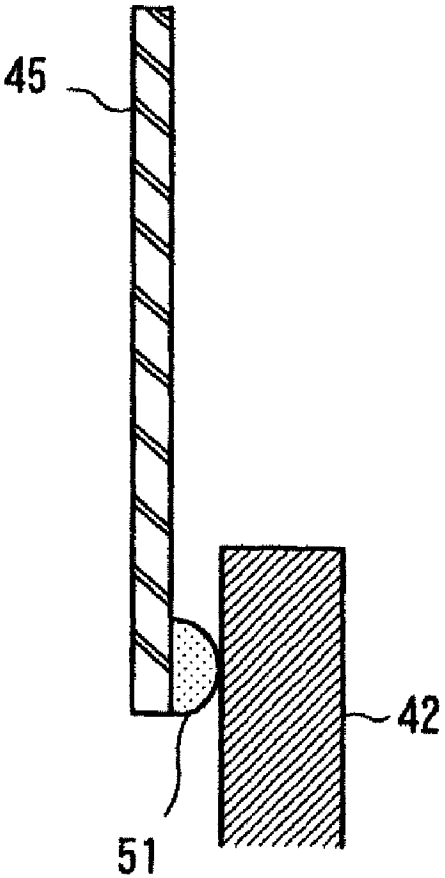

Further, FIGS. 8A and 8B show modified examples of this embodiment, which are different from this embodiment in the contact portion between the toner catching member 45 and the blade 42.

In FIG. 8A, at the contact portion of the toner catching member 45 side with the blade 42, a projection 51 is formed by applying and securing, for example, synthetic resin thereto. In the deformation of the toner catching member 45, the blade 42 is pressed by this projection 51.

Further, in FIG. 8B, a projection 51 similar to that in FIG. 8A is formed on the blade 42 side, and the deformation of the toner catching member 45 is received by this projection 51.

According to such the constitutions, a point where the toner catching member 45 presses the blade 42 can be concentrated to some degree, so that the press force given to the blade 42 can be more effectively applied.

Further, though such the projection 51 can be readily form by, for example, screen printing or the like, a projection 51 may be formed separately from the toner catching member 45 or the blade 42 and secured to it by an adhesive. Furthermore, though a case where the projection 51 is formed in section in the substantially semi-circular shape is shown, the shape of the projection 51 is not limited in particular but may be square in section. Furthermore, as long as the projection 51 can provide the press force against the blade 42, it may have some degree of elasticity.

Embodiment 3

Figure 9A:
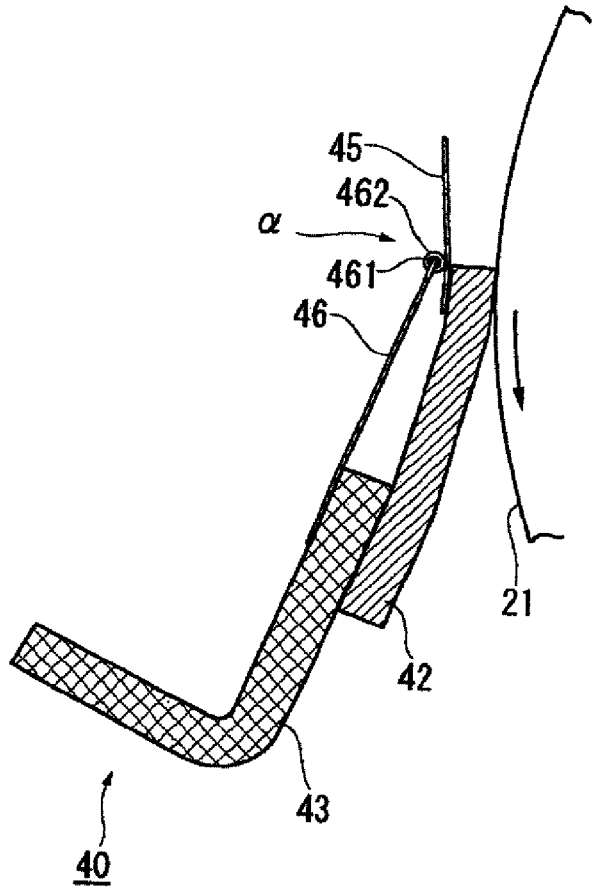
FIG. 9A is an explanatory view showing an outline of a cleaning unit according to a third exemplary embodiment.

FIG. 9A shows an outline of a cleaning unit 40 in a third exemplary embodiment. The cleaning unit 40 in this embodiment has the substantially similar constitution to the constitutions of the cleaning units 40 in the first and second embodiments, but it is different from the units in the first and second embodiments in a swingably supporting mechanism for a toner catching member 45. Further, components similar to those in the first embodiment are denoted by the same characters, and the detained description of them is omitted here.

The swingably supporting mechanism in this embodiment includes a swing shaft 461 which supports swingably the toner catching member 45, and a bearing portion 462 which receives this swing shaft 461. At this time, the swing shaft 461 is provided for one of the toner catching member 45 and the attachment member 46, and the bearing portion 462 is provided for the other of them.

Figure 9B:
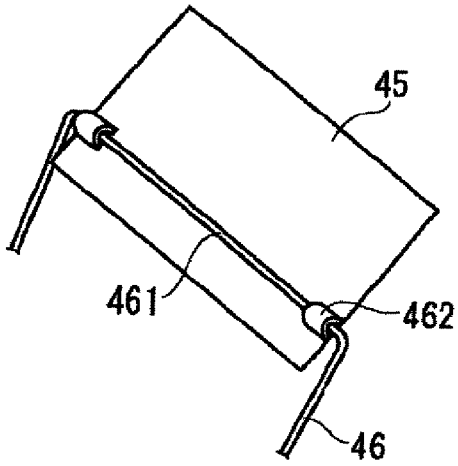
FIG. 9B is an explanatory view showing a constitution of a toner catching member.

FIG. 9B shows a constitution in which the swing shaft 461 and the attachment member 46 are integrated, in which the bearing portion 462 is provided for a part of the toner catching member 45 (the bearings portions 462 are provided in two positions on both sides of the toner catching member 45 in this example, but may be appropriately provided), and the toner catching member 45 can swing by the swing shaft 461. This bearing portion 462 can be formed, for example, as follows: when the toner catching member 45 is manufactured, the corresponding portion to the bearing portion 462 is protruded by pressing, and the opposite side is sealed with a tape. By inserting the swing shaft 461 into the bearing portions 462, the toner catching member 45 can swing.

Figure 9C:
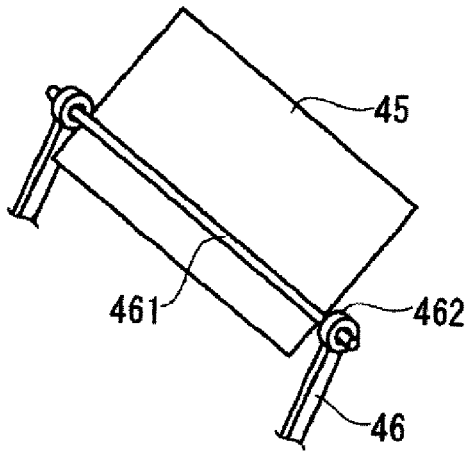
FIG. 9C is an explanatory view showing another constitution of a toner catching member.

Further, in FIG. 9C, the swing shaft 461 is secured to the toner catching member 45, the bearing portions 462 which support swingably the swing shaft 461 are provided on both end sides of this swing shaft 461, and the bearing portions 462 are fixed to the attachment member 46, whereby the toner catching member 45 can swing.

By adopting such the constitution, in the embodiment, the toner catching member 45 deforms based on the amount of the toner stored in the storing area, whereby the press force against the blade 42 can be provided.

In particular, in the embodiment, though the toner catching member 45 can swing freely, since one end side of the toner catching member 45 comes into contact with the blade 42 when the cleaning unit 40 is arranged in the predetermined position, a swing locus of the toner catching member 45 is limited, so that the toner catching member 45 deforms based on the stored amount of the toner. Further, as the toner catching member 45, the member of which the end portion (corresponding to the press portion) on the blade 42 side extends linearly as in the first embodiment is shown, but the toner catching member 45 may have a curved portion as in the second embodiment.

Embodiment 4

Figure 10:
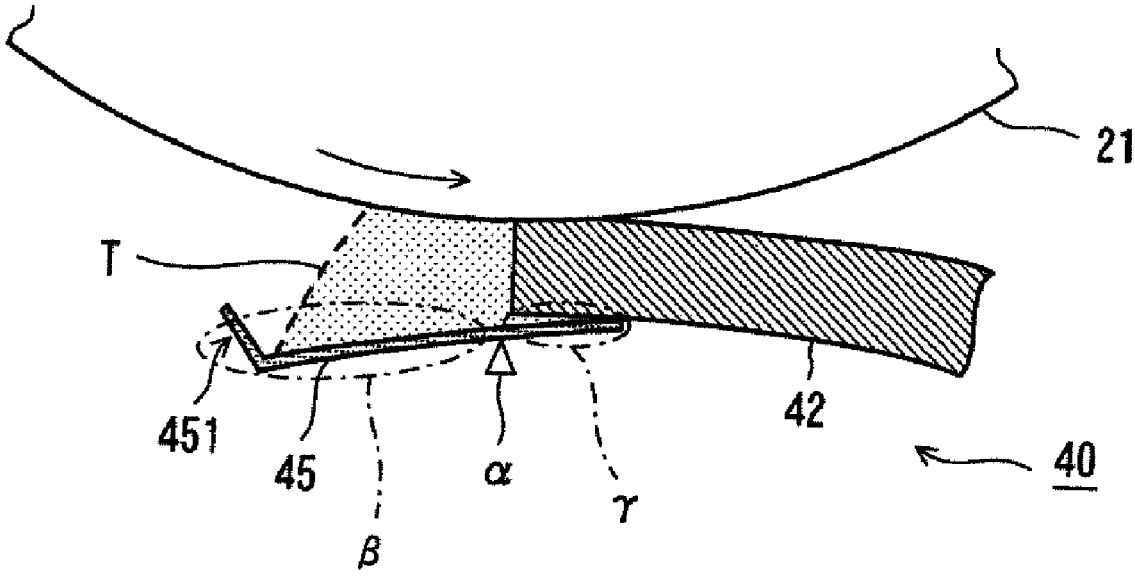
FIG. 10 is an explanatory view showing an outline of a cleaning unit according to a fourth exemplary embodiment.

FIG. 10 shows an outline of a cleaning unit 40 as a modified example of the first embodiment. The cleaning unit 40 in this embodiment is different from that in the first embodiment in arrangement of a blade 42 in relation to a photoconductor 21. Therefore, a leading end portion on a storage moving portion β side of a toner catching member 45 includes a bending portion 451 bending upward so that the toner T can be effectively stored. Further, a swing fulcrum α is constituted similarly to that in the first embodiment. For purpose of easy understanding of explanation, a blade support member and an attachment member are omitted here.

Under such the constitution, as toner T on the photoconductor 21 is scraped off by the blade 42, the toner T is gradually stored on the toner catching member 45 side and stored, on the leading end side of the blade 42, to a height where the toner comes into contact with the photoconductor 21. As the toner T stored in the storing area thus increases, the toner T gradually receives a packing operation, so that a force which intends to press the blade 42 toward the right acts. Therefore, when the toner storing amount increases to some degree, the toner T comes to slip between the blade 42 and the photoconductor 21, so that the lubricating property is maintained.

As the toner amount increases more, the storage moving portion β of the toner catching member 45 receives a downward force, while a press portion γ receives an upward force. This upward force applied to this press portion γ comes to act in a direction where the amount of the toner slipping between the blade 42 and the photoconductor 21 is uniformized. Further, in the embodiment, it goes without saying that some degree of toner amount is always necessary for the storing area.

EXAMPLE

Since the frictional force at the contact portion with the blade is a large factor in wear of the photoconductor, a frictional force F and a vertical resistance N which act on the photoconductor are specifically measured in this example. In particular, the larger the frictional force F is, the larger the wear of the photoconductor becomes; and in case of the small frictional force F, the smaller a difference ΔF of the frictional force F by difference of the amount of the supplied toner is, the smaller the wear of the photoconductor becomes. Therefore, an attention is paid to the frictional force F to perform evaluation.

Figure 11A:
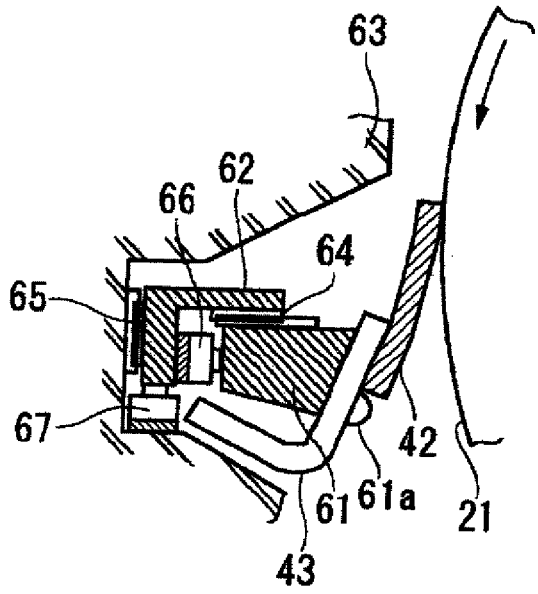
FIGS. 11A and 11B are explanatory views showing a measurement jig used in an example.
Figure 11B:
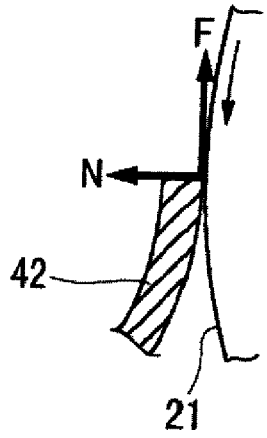

The measurement of the frictional force F and the vertical resistance N was performed by means of a measurement jip shown in FIG. 11A, and coefficient of friction μ was calculated from F/N. Further, FIG. 11B shows the frictional force F and the vertical resistance N at the contact area between the blade 42 and the photoconductor 21.

In the measurement jig in this example, as shown in FIG. 11A, the blade support member 43 which fixes and supports the blade 42 was fixed to an inclined reception surface of an attachment base 61 with a screw 61*a*. An L-shaped moving base 62 is provided at the back of this attachment base 61, a slider 64 which can slide between this moving base 62 and the attachment base 61 is provided, and a load cell 66 for measuring load (corresponding to the vertical resistance N) along the sliding direction of the attachment base 61 is provided for the moving base 62. Further, a slider 65 which can slide in the vertical direction in the figure between a fixing support base 63 of the jig and the moving base 62 is provided for the moving base 62, and a load cell 67 for measuring load (corresponding to the frictional force F) along the sliding direction of the moving base 62 is provided for the fixing support base 63.

By means of such the measurement jig, after the predetermined amount of toner was stored on the blade leading end, in order to confirm influences by the presence of new toner supply, difference in loads was measured, using two kinds of images (background (white) image/100% solid image) as an image on the photoconductor.

Storage conditions for the evaluation are the following four conditions:

(a) There is a toner catching member (this example): first embodiment.

(b) There is no storing area (no toner storage)

(c) There is a small storing area (protrusion type small size)

(d) There is a large storing area (protrusion type large size).

Herein, (b) to (d) show comparative examples. Further, as a measurement value, force per length (herein, gf/mm is used. (1 gf/mm=9.8 N/m)) was found.

In result, a result shown in FIG. 12 was obtained.

It was confirmed that: in this example, the frictional force F in case of the background (white) image was 2.75 gf/mm; and difference ΔF in frictional force F between the background (white) image and the 100% solid image was 0.25 gf/mm. Namely, it was found that: in case of the background (white) image, the toner slipped between the photoconductor and the blade to some degree; and in case of the 100% solid image, the press force was applied to the blade by the toner catching member, and the amount of the slipping toner was limited. From this result, it was understood that: even in case that the toner storing amount on the storing area changed according to the image on the photoconductor, the stable cleaning performance by the blade was secured and longer lives of the blade and the photoconductor was also possible.

Next, under the condition of no toner storage, the frictional force F in case of the background (white) image was a large value of 4.2 gf/mm; a large difference ΔF in frictional force F appeared between the background (white) image and the 100% solid image; and the frictional force F in case of the background (white) image was larger than that in case of the 100% solid image by 1.45 gf/mm. From this result, it was confirmed that: in case that the amount of the scraped toner was small, the amount of the toner slipping between the blade and the photoconductor was small; and the frictional force F was greatly affected by the amount of the scraped toner.

Further, under the condition of the protrusion type (small size), the frictional force F in case of the background (white) image was a large value of 3.3 gf/mm; and the frictional force F in case of the background (white) image was larger than that in case of the 100% solid image by 0.8 gf/mm. From this result, it was confirmed that: though the storing area was provided, the storing area was too narrow and the toner storing amount was insufficient.

On the other hand, under the condition of the protrusion type (large size), the frictional force F and the vertical resistance N were smaller than those under other conditions. In case of the background (white) image, the frictional force F was 2.25 gf/mm, and the vertical resistance N was 4.5 gf/mm. Further, the difference ΔF in frictional force F between the background (white) image and the 100% solid image was a small value of 0.25 gf/mm. This means that the catching member receives force in the spreading direction due to the toner in the storing toner and the blade receives force in a direction apart from the photoconductor by this force. Therefore, under this condition, it was confirmed that: a toner slip-through defect was produced and the cleaning performance lowered, though the frictional force F in case of the 100% solid image was a small value of 2.0 gf/min.

What is claimed is:

1. A cleaning unit comprising:

a cleaning housing having an opening portion opposed to a cleaned member; and a cleaner which is disposed in the cleaning housing correspondingly to the opening portion and which cleans toner on the cleaned member, wherein the cleaner includes:

a support member supported by the cleaning housing;

a toner scraping member which is fixed to the support member and which comes at an leading end portion thereof into contact with the cleaned member against a moving direction of the cleaned member so as to scrape off the toner on the cleaned member; and a toner storing mechanism which stores temporarily the toner scraped off by the toner scraping member, the mechanism being provided upstream of the leading end portion of the toner scraping member in the moving direction of the cleaned member, wherein the toner storing mechanism includes:

a toner catching member which is provided in a vicinity of the leading end portion of the toner scraping member so as to catch the toner scraped off by the toner scraping member; and an attachment member which is fixed to the cleaning housing or the support member, and a swingably supporting mechanism which is fixed to the attachment member supporting swingably the toner catching member with middle portion of the toner catching member as a swing fulcrum, and wherein a free end portion of the toner catching member protrudes from the toner scraping member with respect to the swing fulcrum as a boundary, and a portion opposite to the free end portion of the toner catching member with respect to the boundary is set between the attachment member and the toner scraping member.

2. The cleaning unit according to claim 1, wherein the swing fulcrum for the toner catching member is set in a position where the free end portion becomes longer than the portion opposite to the free end portion.

3. The cleaning unit according to claim 1, wherein the toner scraping member comes into contact with the cleaned member so that the leading end portion faces upwardly.

4. The cleaning unit according to claim 1, wherein the toner catching member is formed of a bendable and deformable member.

5. The cleaning unit according to claim 1, wherein the swingably supporting mechanism couples the toner catching member through a coupling tape to the attachment member to form a coupling portion, and the coupling portion is the swing fulcrum.

6. The cleaning unit according to claim 1, wherein the portion opposite to the free end portion has a shape extending linearly.

7. The cleaning unit according to claim 1, wherein the portion opposite to the free end portion is configured in U-shape.

8. The cleaning unit according to claim 1, wherein the swingably supporting mechanism includes a swing shaft at one of the toner catching member or the attachment member, and a bearing at the other of the toner catching member or the attachment member, and the swing shaft is the swing fulcrum.

9. An image forming apparatus including:

an image forming section which forms a toner image on an image carrier; and a cleaning unit according to claim 1 which is opposed to the image carrier and cleans toner on the image carrier.

10. The cleaning unit according to claim 1, wherein the free end portion of the toner catching member is a storage moving portion which moves based on an amount of toner stored temporarily by the toner storing mechanism, and the portion opposite to the free end portion is a press portion which presses the toner scraping member toward the cleaned member based on a moving amount of the storage moving portion.

11. The cleaning unit according to claim 1, where in the storage moving portion is arranged so that the leading end portion comes close to the cleaned member from an outside of the toner scraping member.

12. The cleaning unit according to claim 1, wherein the swingably supporting mechanism includes a swing shaft which is set at the toner catching member or the attachment member, and the swing shaft is the swing fulcrum.

13. A cleaner which is provided for a cleaning housing having an opening portion opposed to a cleaned member and cleans toner on the cleaned member, the cleaner comprising:

a support member supported by the cleaning housing;

a toner scraping member which is fixed to the support member and which comes at an leading end portion thereof into contact with the cleaned member against a moving direction of the cleaned member so as to scrape off the toner on the cleaned member; and a toner storing mechanism which stores temporarily the toner scraped off by the toner scraping member, the mechanism being provided upstream of the leading end portion of the toner scraping member in the moving direction of the cleaned member, wherein the toner storing mechanism includes:

a toner catching member which is provided in a vicinity of the leading end portion of the toner scraping member so as to catch the toner scraped off by the toner scraping member; and an attachment member which is fixed to the cleaning housing or the support member, and a swingably supporting mechanism which is fixed to the attachment member supporting swingably the toner catching member with middle portion of the toner catching member as a swing fulcrum, and wherein a free end portion of the toner catching member protrudes from the toner scraping member with respect to the swing fulcrum as a boundary, and a portion opposite to the free end portion of the toner catching member with respect to the boundary is set between the attachment member and the toner scraping member.

14. The cleaner according to claim 13, wherein the swing fulcrum for the toner catching member is set in a position where the free end portion becomes longer than the portion opposite to the free end portion.

15. The cleaner according to claim 13, wherein the toner scraping member comes into contact with the cleaned member so that the leading end portion faces upwardly.

16. The cleaner according to claim 13, wherein the toner catching member is formed of a bendable and deformable member.

17. The cleaning unite according to claim 13, wherein the swingably supporting mechanism couples the toner catching member through a coupling tape to the attachment member to form a coupling portion, and the coupling portion is the swing fulcrum.

18. The cleaning unit according to claim 13, wherein the free end portion of the toner catching member is a storage moving portion which moves based on an amount of toner stored temporarily by the toner storing mechanism, and the portion opposite to the free end portion is a press portion which presses the toner scraping member toward the cleaned member based on a moving amount of the storage moving portion.

19. The cleaning unit according to claim 13, where in the swingably supporting mechanism includes a swing shaft which is set at the toner catching member or the attachment member, and the swing shaft is the swing fulcrum.

* * * * *